United States Patent [19]

Noland et al.

[11] Patent Number: 4,909,508

[45] Date of Patent: Mar. 20, 1990

[54] GOLF TEES

[75] Inventors: Donald P. Noland, Edmonton; Peter B. Fransham, Calgary, both of Canada

[73] Assignee: Peat "T", Inc., Edmonton, Canada

[21] Appl. No.: 309,379

[22] Filed: Feb. 13, 1989

[51] Int. Cl.[4] ..... A63B 57/00

[52] U.S. Cl. ..... 273/33; 273/212

[58] Field of Search ..... 273/33, 212, 32 D

[56] References Cited

U.S. PATENT DOCUMENTS

| | | | |
|---|---|---|---|
| 638,920 | 12/1899 | Grant | 273/207 |
| 1,142,997 | 6/1915 | True | 273/202 |
| 1,538,173 | 5/1925 | Daugharty | 273/33 |
| 1,618,391 | 8/1928 | Bratt | 273/33 |
| 1,759,657 | 5/1930 | McLeod | 273/33 |
| 1,815,521 | 7/1931 | McLeod | 273/33 |
| 1,850,560 | 3/1932 | Middendorf | 273/33 |
| 3,351,258 | 11/1967 | Evantosh | 273/33 |
| 3,884,479 | 5/1975 | Gordos | 273/212 |
| 4,360,199 | 11/1982 | Jackson | 273/32 D |

*Primary Examiner*—T. Brown

*Attorney, Agent, or Firm*—Arne I. Fors; D. Doak Horne

[57] ABSTRACT

A golf tee made from peat moss admixed with a water soluble binder in an amount sufficient to bond the peat moss together in a coherent and rigid body by cold or hot pressure forming is disclosed. The water soluble binder may be a lignosulphonate in an amount up to 50%, preferably about 10 to 30%, by weight of the composition. The composition preferably has a moisture content of 5 to 22%, preferably 9 to 18%, by weight. The water soluble binder may be a water soluble polymer in an amount of 3 to 20%, preferably 5 to 15% and more preferably 8 to 10% by weight of the composition.

25 Claims, No Drawings

GOLF TEES

BACKGROUND OF THE INVENTION

This invention relates to golf tees and, more particularly, relates to golf tees made from peat moss.

Golf tees conventionally are made from wood or from plastics materials. Both these products are hard and tough and, because they are essentially non-degradable, will remain indefinitely on the golf fairways and greens to cause blade damage and bearing displacement to mowers and punctured tires to vehicles. In addition, plastic tees can cause damage to golf club faces and broken plastic and wood tees often lying on the ground at golf courses are unsightly.

It is a principal object of the present invention to provide golf tees of a naturally-occurring, degradable material which will simulate in appearance conventional golf tees made of wood or plastic but which will soften when exposed to moisture, particularly when broken to expose their interiors to moisture, to decompose rapidly and readily assimilate with natural soils.

SUMMARY OF THE INVENTION

In its broad aspect, the golf tee of the invention comprises a tee formed of a composition containing peat moss and a water soluble binder admixed in an amount sufficient to bond the peat moss together in a coherent and rigid body. More particularly, the golf tee of the invention comprises a tee formed of a composition of peat moss admixed with a water soluble binder hving the characteristics of a binder selected from the group consisting of lignosulphonates and water soluble polymers.

According to a preferred embodiment of our invention, the composition may comprise a water soluble binder having the characteristics of a lignosulphonate in an amount by weight of from 0 to about 50% water soluble binder, preferably in an amount between about 10 to 30% of water soluble binder, and a moisture content by weight of about 5 to 22%, preferably 9 to 18%. Tees produced from this composition can be "cold" formed in a mold at a temperature in the range of from ambient to about 120° F., preferably at a temperature in the range of about 75° to 120° F., at a high rate of production of about 3600 tees per hour per compression machine.

According to another embodiment of our invention, the golf tee comprises a tee formed of a composition of peat moss admixed with a water soluble polymer binder in the range of 3 to 20% by weight, preferably in the range of 5 to 15% by weight and more preferably in the range of 8 to 10% by weight of the composition, and hot pressing said composition in a mold.

DESCRIPTION OF THE PREFERRED EMBODIMENTS

In accordance with the preferred embodiment of the golf tee of the invention, peat moss preferably having a Von Post rating of greater than three and a particle size of 100% passing a standard #10 mesh sieve is dried to a moisture content of by weight less than about 20% and then mixed with a dry powdered lignosulphonate such as produced as a bi-product of pulp and paper processing or water soluble binder having like characteristics in an amount to provide a composition having 0 to 50% by weight, preferably about 10 to 30% by weight lignosulphonate or its water soluble equivalent. The final moisture content of the resulting composition is adjusted to about 9 to 22% by weight moisture to provide a mixture having a consistency of a free-flowing fine-grained powder. Two grams of the peat composition is placed in a mold having the cavity configuration of a standard golf tee and compressed at ambient temperature, preferably at a temperature in the range of about 75° to 120° F., i.e. cold pressed, with sufficient pressure to form a dense, strong and hard golf tee. The pressure will depend on the composition and shape of the mold cavities and preferably is in excess of 20,000 pounds per square inch. Conventional compaction presses can be used to form the tees at a commercially viable rate of about 3600 tees per hour.

In accordance with a second embodiment of the invention, a composition comprised of peat moss admixed with a water soluble polymer binder in the range of 3 to 20% by weight, preferably in the range of 5 to 15% by weight and more preferably in the range of 8 to 10% by weight of water soluble polymer binder, is pressed in a mold having the configuration of a standard golf tee at a temperature in the range of 80° to 120° F. The particulate peat moss is admixed with an amount of polymer binder sufficient to bond the peat moss together into a coherent and rigid body by heat moulding under pressure in a desired tee shape. Polymer binders such as polyvinyl alcohol (PVA) and polyvinylpyrrolidone (PVP) have been found suitable.

A water absorption, i.e. hygroscopic, enhancer can be incorporated into the composition as may be desirable depending on the average humidity in an area and the rate at which the tees are to soften. The peat moss composition having for example 8% PVP binder moulded into a tee in accordance with the invention normally has inadequate hygroscopic properties to absorb sufficient moisture from the air to soften the tee. The addition of a hygroscopic constituent for use in relatively dry climates having low humidities, such as a 15% humidity, may be desirable.

A fertilizer such as urea can also be admixed into the composition in an amount which will not adversely affect the strength and rigidity of the tees.

The resulting pressed compositions in tee shape according to the foregoing embodiments may be coated such as by dipping with a non-toxic and inert paint or lacquer, i.e. having a degree of water insolubility, to provide resistance to water wetting and to avoid premature water absorption and softening of the peat moss composition.

The method and composition of the invention will now be described with reference to the following non-limitative examples.

EXAMPLE I

A 2 gram sample containing 10% lignosulphonate and 90% peat moss with a Von Post rating of 4 to 5 and a moisture content of less than 15% was place in a test mold. The mixture could not be compressed up to 20,000 pounds per square inch because of mold limitations and was too brittle to remove from the mold. Cracks with slickensides were noted suggesting movement of the two opposing pieces along the shear plane.

EXAMPLE II

A 2 gram sample identical to the sample of the foregoing example, but with a moisture content of 18%, consistently yielded tees with the desired qualities.

However, it was found by experimentation that the mold temperatures preferably should fall between 75° F. and 120° F. At a temperature outside of this range, the mixture adhered to the walls of the mold in spite of the addition of a graphite based lubricant.

EXAMPLE III

A sample identical to the sample in Example I, except for the moisture content being greater than 22%, did not form a tee with the desired strength characteristics. Furthermore, the mixture tended to adhere to the walls of the mold in spite of the addition of a lubricant.

EXAMPLE IV

A ¾" cylindrical disk ¼" thick was formed using a ram type mold, The mixture was identical to that of example I except that the moisture content was about 9%. A very hard and dense pellet was formed indicating that with pressure and a solid mold, adequate strength characteristics can be achieved.

EXAMPLE V

Pellets formed in a manner similar to that of Example IV, but with varying percentages of lignosulphonate, disintegrated at different rates. Pellets formed with 100% peat similar to Example I disintegrated rapidly when immersed in water, Pellets formed with more than 20% lignosulphonate by dry weight maintained their shape for up to 2 days when totally immersed in still standing water. The rate of disintegration can therefore be adjusted by varying the percentage of lignosulphonate. The lower the percentage of lignosulphonate, the faster the rate of disintegration and conversely the higher the percentage of lignosulphate the slower the rate of disintegration.

EXAMPLE VI

The combination of fine grained peat having a Von Post rating greater than 3 with up to 50% by weight lignosulphonate resulted in a tee with a dark brown to black colour and a shiny exterior surface. This combination produces a tee with aesthetic qualities acceptable to the end users.

The tees according to the present invention are sufficiently strong and rigid to permit pressing into the ground and the support of a golf ball. The exterior coating, if used, imparts a degree of water resistance to the tee and prevents premature absorption of water into the peat moss while adding to the tee rigidity. Upon exposure to moisture, particularly after fracturing of the tee during use, the absorptive nature of the peat moss allows moisture by way of dew, rain or ground water such as irrigation sprinkler water to expand and soften the tee, permitting mulching of the tee by mowers without damage to the equipment. The addition of a hygroscopic agent, if desired for example to enhance the rate of absorption of moisture such as from humidity, particularly in dry climates, accelerates the softening and decomposition of the tees.

It will be understood of course that modifications can be made in the embodiment of the invention illustrated and described herein without departing from the scope and purview of the invention as defined by the appended claims.

We claim:

1. A method of forming golf tees comprising providing a composition of peat moss admixed with a water soluble binder in an amount sufficient to bond the peat moss together in a coherent body and forming said golf tees in a mold under pressure.

2. A method as claimed in claim 1 in which said water soluble binder has the characteristics of a binder selected from the group consisting of lignosulphonates and water soluble polymers.

3. A method as claimed in claim 1 in which said water soluble binder is a lignosulphonate and said composition comprises by weight up to about 50% lignosulphonates and the balance peat moss containing moisture, and adjusting the moisture content within the range of about 5 to 22% by weight.

4. A method as claimed in claim 3 in which said peat moss has a Von Post rating of greater than 3 and a particle size of 100% passing a standard #10 mesh sieve.

5. A method as claimed in claim 4 in which said lignosulphonate is present in an amount in the range by weight of about 10 to 30% and said moisture content is adjusted within the range by weight of about 5 to 22%.

6. A method as claimed in claim 3 in which said golf tees are formed in a mold under pressure sufficient to form dense, strong and hard tees at a temperature within the range of ambient temperature to about 120° F.

7. A method as claimed in claim 3 in which said golf tees are formed in a mold under pressure of at least 20,000 pounds per square inch sufficient to form dense, strong and hard tees at a temperature within the range of about 75° to 120° F.

8. A method as claimed in claim 1 in which said water soluble binder is a water soluble polymer in an amount by weight of 3 to 20% and said golf tees are formed under pressure in a mold at an elevated temperature.

9. A method as claimed in claim in claim 8 in which said golf tees are formed at an elevated temperature in the range of about 80° F. to 120° F.

10. A method as claimed in claim 9 in which said water soluble polymer is present in an amount by weight of about 5 to 15%.

11. A method as claimed in claim 9 in which said water soluble polymer is present in an amount by weight of about 8 to 10%.

12. A golf tee formed from a composition comprising peat moss and a water soluble binder in an amount sufficient to bond the peat moss together in a coherent and rigid body.

13. A golf tee formed from a composition comprising peat moss and a water soluble binder having the characteristics of a binder selected from the group consisting of lignosulphonates and a water soluble polymer in an amount sufficient to bond the peat moss together in a coherent and rigid body.

14. A golf tee as claimed in claim 13 in which said tee is coated with a water insoluble non-toxic coating of paint or lacquer to provide resistance to water wetting.

15. A golf tee as claimed in claim 13 additionally comprising a hygroscopic constituent for enhancing absorption of water.

16. A golf tee formed from a composition comprising peat moss and a water soluble binder having the characteristics of a lignosulphonate in an amount by weight of up to about 50% sufficient to bond the peat moss together in a coherent and rigid body, and the balance peat moss, said composition having a moisture content by weight of about 5 to 22%.

17. A golf tee as claimed in claim 16 in which said water soluble binder is a lignosulphonate.

18. A golf tee as claimed in claim 16 in which said water soluble binder is lignosulphonate present in an amount by weight of 0 to about 50%.

19. A golf tee as claimed in claim 18 in which said composition has a moisture content by weight of about 5 to 22%.

20. A golf tee as claimed in claim 18 in which said composition has a moisture content by weight of about 9 to 18%.

21. A golf tee as claimed in claim 16 in which said water soluble binder is lignosulphonate present in an amount by weight of about 10 to 30%.

22. A golf tee as claimed in claim 16 in which said peat moss has a Von Post rating of greater than 3 and a particle size of 100% passing a standard #10 mesh sieve.

23. A golf tee formed from a composition containing peat moss comprising a water soluble binder having the characteristics of a water soluble polymer in an amount by weight of about 3 to 20%, and the balance peat moss.

24. A golf tee formed from a composition containing peat moss comprising a water soluble polymer binder having the characteristics of a water soluble polymer in an amount by weight of about 5 to 12%, and the balance peat moss.

25. A golf tee formed from a composition containing peat moss comprising a water soluble binder having the characteristics of a water soluble polymer in an amount by weight of about 8 to 10%, and the balance peat moss.

* * * * *